US005373580A

United States Patent [19]

Shao

[11] Patent Number: 5,373,580

[45] Date of Patent: Dec. 13, 1994

[54] STRUCTURE OF COOLER-HEATER FAN

[76] Inventor: Steve Shao, 3F, No. 348, Sec. 2, Ming-chi Rd., Taisan, Taipei, Taiwan, Prov. of China

[21] Appl. No.: 167,368

[22] Filed: Dec. 16, 1993

[51] Int. Cl.[5] ..... F24H 3/04

[52] U.S. Cl. ..... 392/366

[58] Field of Search ..... 392/366, 365, 360, 367, 392/368, 369

[56] References Cited

U.S. PATENT DOCUMENTS

| | | | |
|---|---|---|---|
| 1,429,085 | 9/1922 | McGary | 392/366 |
| 1,472,124 | 10/1923 | Howe | 392/366 |
| 1,490,960 | 4/1924 | Carduner | 392/366 |
| 1,509,367 | 9/1924 | Miller | 392/366 |
| 1,958,007 | 5/1934 | MacDougall | 392/366 |
| 1,967,757 | 7/1934 | Losee | 392/366 |
| 2,765,393 | 10/1956 | Theisen | 392/366 |
| 4,703,152 | 10/1987 | Shih-Chin | 392/366 |
| 5,133,042 | 7/1992 | Pelonis | 392/365 |

*Primary Examiner*—Teresa J. Walberg

*Attorney, Agent, or Firm*—Lowe, Price, LeBlanc & Becker

[57] ABSTRACT

A cooler-heater fan which differs from a conventional heater fan in that the air flow can be delivered in a slanted direction is described. The structure includes a heating apparatus, a fan motor and a fan blade assembly which are housed in a fan body, so that said fan body and the main body of the fan are separate structures. A tilt switch for safety shutdown is provided inside the main body. A spindle is provided in a tilted position protruding from the fan body. A spindle opening is provided in the main body to accommodate the spindle so that the latter can rotate therein. When the fan body is rotated to a slanted position to deliver the air flow, the main body stays upright, and the safety feature of the tilted switch is not affected. A hoop is also provided to secure the fan body. The hoop is made of a resilient metal wire and is used to secure the mounting of the fan body and allow a user to adjust the position of the fan body manually.

3 Claims, 4 Drawing Sheets

STRUCTURE OF COOLER-HEATER FAN

BACKGROUND OF THE INVENTION (a) Field of the Invention

The present invention relates to a new structure of cooler-heater fan, particularly to a fan structure in which the fan body uses a spindle for rotation so as to enable the fan assembly to deliver air flow in a slanting direction.

(b) Description of the Prior Art

Heater fan are generally used in cold-weather area. The heater fan is differed from a cooler fan in that a heating apparatus is usually added behind the fan blade assembly. The heat generated from the heating apparatus is drawn by the fan blade so that hot air can be blown out. When the heating apparatus is shut off, the heater fan functions the same as the cooler fan. This is also the basic principle of the dual purpose cooler-heater fan.

However, the addition of the heating apparatus brings cut a safety concern. The heating apparatus, if not properly handled, can start a fire. Therefore, the use of the heating apparatus is restricted by the following:

1. The materials used to manufacture the heater fan have to be fire proof and be able to withstand a high temperature. These materials usually are more expensive.

2. For safety consideration, the heating apparatus in the heater fan has to be standardized. The heating apparatus has to be limited in power, and this indirectly confines the size of the heater fan.

3. A safety tilt switch is provided inside the heater fan. When the heater fan is placed in a tilted position exceeding a certain limit, the safety tilted switch automatically shuts off the heater power to the fan assembly. This feature is designed to prevent a fire in case the fan assembly is accidentally knocked over.

It can be seen from the above description that the safety requirement for the manufacturing of the heater fan is more critical than that for the cooler fan. Because of its compact size, most of the heater fans are designed to have a one-piece structure. Also because of the requirement of the safety tilt switch, the majority of the heater fans cannot deliver and air flow that is adjustable in a slanted direction. The Inventor, after accepting comments and recommendations from many users, has come up with a new structure for the cooler-heater fan in which the angle of the air flow is adjustable, thereby meeting the demand of the public.

SUMMARY OF THE INVENTION

The main object according to the present invention is to provide a new structure for cooler-heater fan in which the fan body for delivering hot air and the main body of the fan assembly are separated into two different structures. The fan body is provided with a spindle which is received in a spindle opening of the main body. The mounting allows the fan body to be operated with the spindle and the shut down feature of the safety tilted switch is not affected.

Another object according to the present invention is to provide a new structure for cooler-heater fan in which a simple hoop is used. The hoop is coiled from a resilient metal wire and its two ends are extended into two legs for ease of mounting. The hoop is provided to grip tightly onto the spindle so that the two can be rotated simultaneously. This also provides a manual adjustment of the direction of the fan body.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
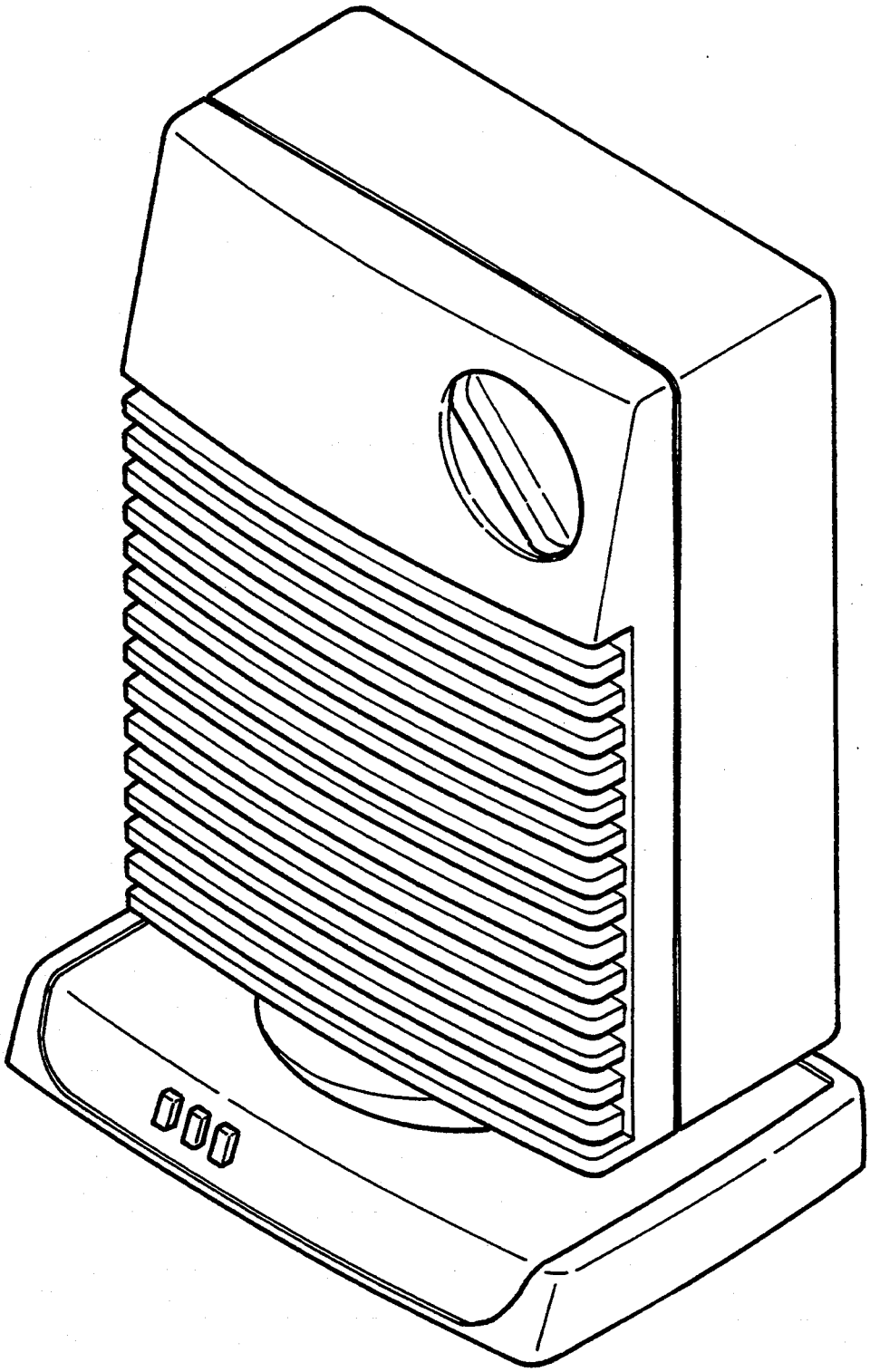
FIG.1 PRIOR ART
FIG. 1 is a perspective view of the heater fan according to the present invention.

The structure of a heater fan is shown in FIG. 1. The size of the structure is generally small because of the limitation of the heating apparatus, which has to meet the safety standard. Therefore, the designer usually looks at the heating apparatus and the fan body as a whole structure. The tilt switch (A) as described is provided inside the fan body (B). Therefore, when an adjustment is made to the air outlet (B1), the operation of the tilted switch (A) can possibly be affected. The tilted switch (A) as described here is a conventional component, it mainly consists of a weight block (A1) suspending in a downward position. If the main body (B) of the fan is knocked down causing the weight block (A1) to be tilted, then the two contacting spring plates (A2) that are controlled by the weight block (A1) will be disengaged, thereby cutting off the power to the fan assembly. The angle controlled by the weight block (A1) is approximately 15 degrees, and this causes some design problems in having the air flow from the fan delivered at an angle.

Figure 2:
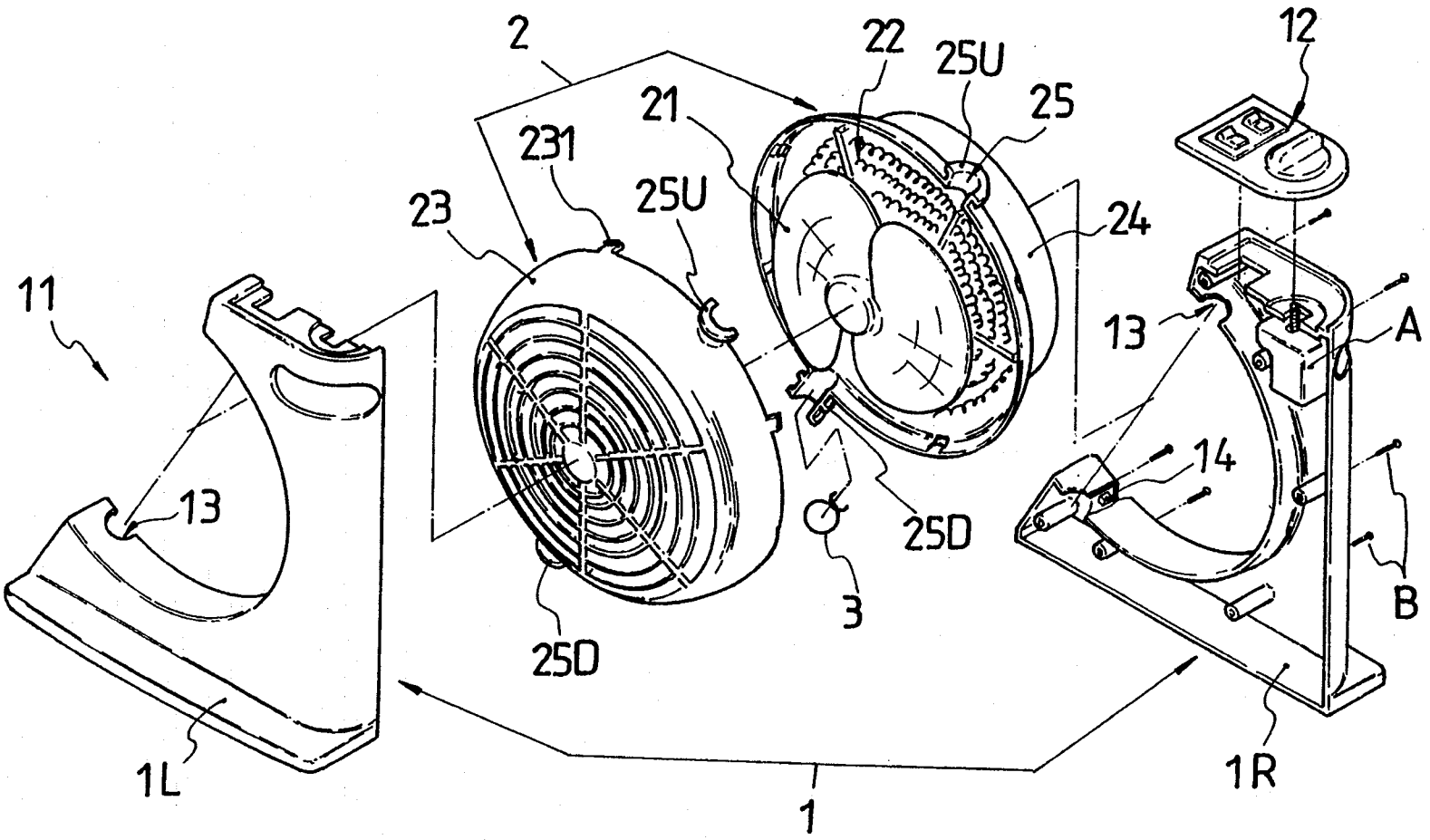
FIG. 2 is a perspective fragmented view of the cooler-heater fan according to the present invention.

The main concept of the design according to the present invention is shown in FIG. 2. The heater fan is split up into two major parts: a main body (1) and a fan body (2). The fan body (2) consists of a fan blade assembly, a fan motor and a heating apparatus (22). The fan body (2) operates to deliver cool or hot air. The main body (1) consists of a control switch (12) (including the tilt switch (A)) for controlling the operation of the fan body (2). The fan body (2) is mounted inside the main body (1) in a tilted position. When the fan body (2) is tilted, the main body (2) holds it firmly in place so that the air flow can be delivered in a slanted mode.

In the embodiment as shown in FIG. 2, the fan body (2) is made up of a front grill (23) and a rear casing (24). The fan blade (21), motor and the heating apparatus (22) are housed inside the rear casing (24). The front grill (23) is provided with clip members (231) in its periphery for quick attachment to the rear casing (24). The assembled fan body (2) is provided, with a longitudinally extending spindle (25) protruding from the edge thereof so that the fan body (2) can be rotated thereabout. In this embodiment, the spindle (25) is split, for ease of manufacturing, into two halves respectively located in the front grill (23) and the rear casing (24). When the two pieces are put together, the completed spindle (25) is formed. In addition, the spindle (25) is provided in two places (25U), (25D) for stable support of the fan body (2). The upper spindle (25U) is hollow so that the wiring from the rear casing (24) can be fed through for connecting to a control switch (12) in the main body (1).

Figure 3:
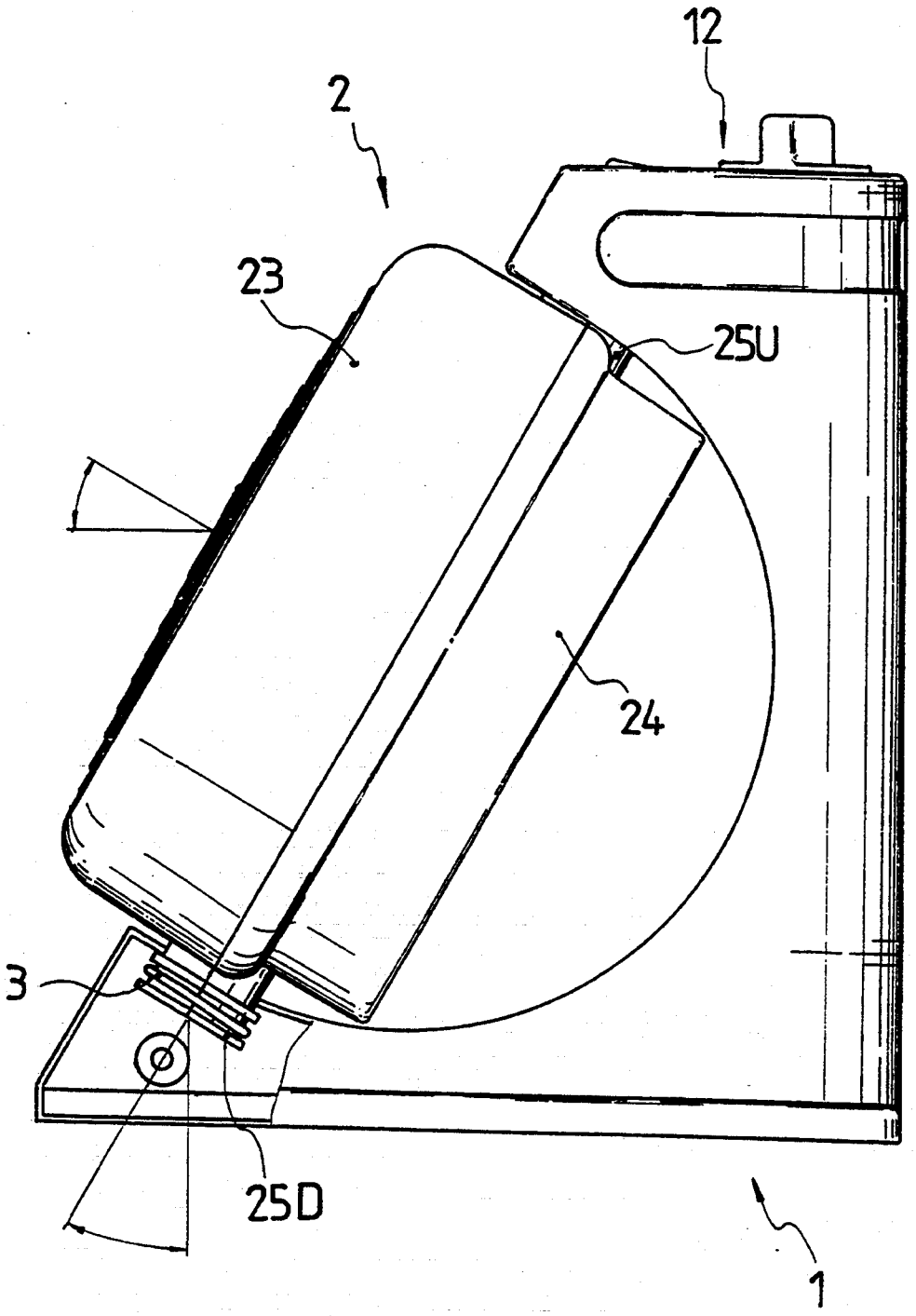
FIG. 3 is a plan view of an assembly of the cooler-heater fan according to the present invention.

The main body (1) as described above is a casing to accommodate the secured mounting of the fan body (2) in a tilted position. In this embodiment, the main body (1) is also split up into a left body (1L) and a right body (1R). Screws (B) are used to secure the left body (1L) and the right body (1R) together, thereby forming the main body (1) in the appropriate locations in the left body (1L) and the right body (1R), spindle openings (13) are provided for accommodating the spindle (25). When the left and the right bodies (1L) (1R) are put together, the spindle openings (13) provided wherein clamp onto the spindle (25) so that the fan body (2) can be properly secured. The axial direction of the spindle openings (13) and the longitudinal direction of the main body (1) forms an angle of approximately 30 degrees, as is shown in FIG. 3. Therefore, when the fan body (2) is rotated to a position facing the front, the air flow from the front grill (23) will also be delivered at a 30 degrees angle tilting upward. This tilt angle can be from 0 to 45 degrees, but the air from the fan shall be designed to blow through the front grille at an upward direction so as to avoid the safety concern when directed in the downward direction. The assembled main body (1) is an upright substantially elongated and flat body one side of which is an open region (11), as is shown in FIG. 2. The fan body (2) is only allowed to oscillate within this opened region (11). In addition, the main body (1) is also provided with a panel for the control switch (12) and the tilt switch (A), which are used to properly control the operation of the fan motor, the heating apparatus (22) and the safety shutdown.

Figure 4:
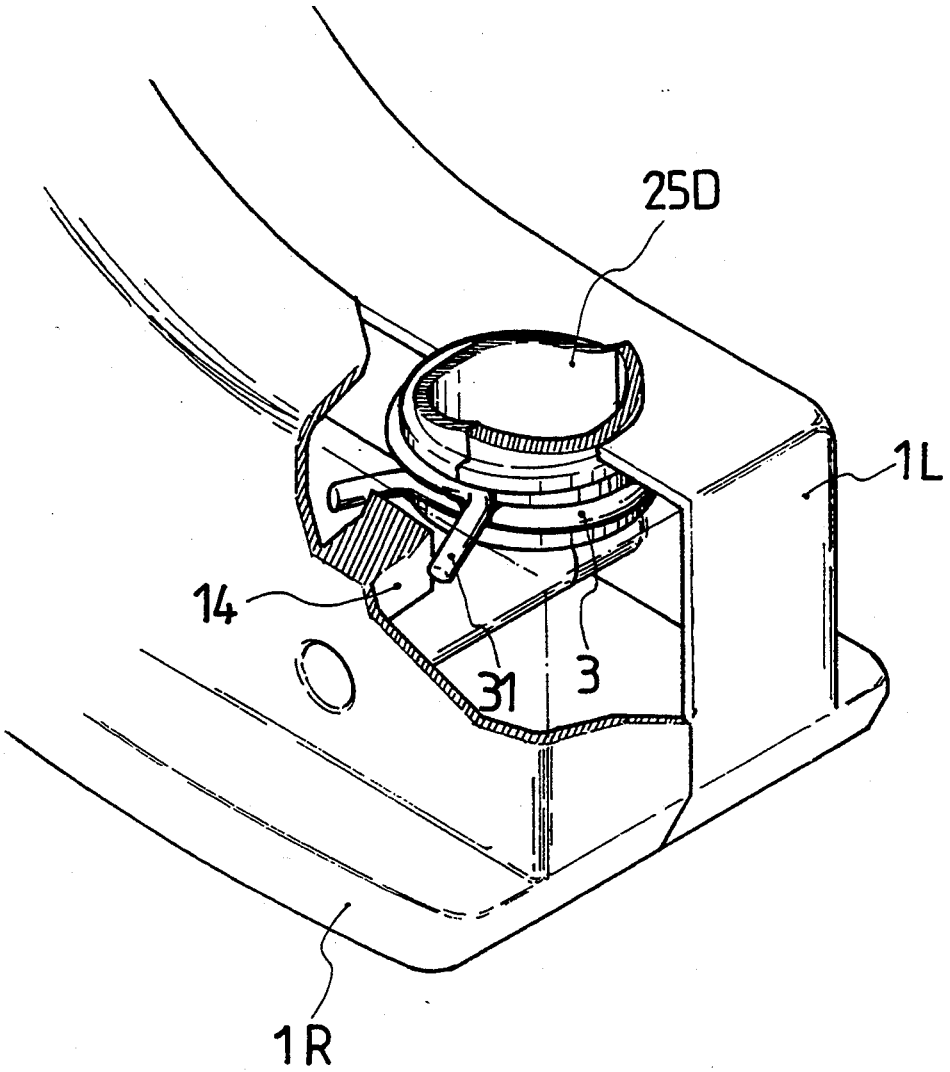
FIG. 4 is a partial sectional view of the cooler-heater fan according to the present invention.

During the design process of the invention, the inventor considered the use of the self-oscillated operation for the fan body (2). However, since the spindle (25) is tilted it was found that the air flow from the front grille (23) is in the form of turbulent wave moving up and down. This was impractical because it differed from a conventional self-oscillating fan, in which the oscillation is in a horizontal direction. Therefore, consideration was made to adjusting the position of the fan body (2) manually. The Inventor has found that the conventional manual adjustment of the fan body (2) can either be the spindle-sleeve type or the screw-in time. The spindle-sleeve type uses the spindle opening to grip onto the spindle tightly, but this gripping does not affect the manual adjustment. Since the manual adjustment causes some friction between the spindle and the opening, they tend to become loose after a period of time. The screw-in type uses something similar to a fastening screw to tighten or loosen the spindle, the manual adjustment of this type is more troublesome. In this invention, the Inventor introduces a simple hoop (3) to accomplish the effect of manual positioning. The structure of this can be observed from the perspective fragmented view of FIG. 2 and the sectional view of FIG. 4. The hoop (3) uses a resilient metal wire to coil and form into a circular shape, and the two ends of the wire are bent and extended to form two legs (31), which are close to each other. The inside diameter of the hoop (3) is slightly less than the diameter of the lower spindle (25D). When the hoop (3) is inserted into the lower spindle (25D), it will be expanded outward due to the resilient force. Therefore, the hoop (3) grips the lower spindle (25D) tightly and the two rotate simultaneously. Then, a block (14) is provided in an appropriate location within the main body (1). This block (14) is provided, when the fan body (2) and the main body (1) are assembled together, in between the two legs (31) of the hoop (3) so that the hoop (3) can be positioned therein. By such configuration, the clamping of the hoop (3) onto the lower spindle (25D) allows the fan body (2) to be secured in place. When a user adjusts the fan body (2) manually and the adjustment force overcomes the resiliency of the hoop (3), then the lower spindle is loosened for oscillation. The description of this process is long and tedious but the manual adjustment on the fan body (2) happens instantaneously.

Lastly, the special feature of the invention is summarized as follows:

1. The present invention differs from the prior art in that the fan body (2) is designed to deliver the air flow in an adjustable slanted mode, moreover, the safety feature of automatic shutoff is still available.

2. The simple hoop (3) is used to enable the function of manual positioning of the fan body (2). This application gives a low cost, ease of positioning, quick adjustment and low friction operation. It is a simple structure with multiple functions.

Although the invention has been described in its preferred form with a certain degree of particularity it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. A new structure for cooler-heater fan comprising: a main body; and a fan body, comprising a fan blade assembly, a fan motor and a heating apparatus for delivery of cool or hot air, said main body comprising a control switch wired to control the operation of said fan body, said fan body having an exterior and a spindle mounted thereon, said main body forming a spindle receiving opening therefor and means for adjusting the position of the fan body, relative to said main body including said spindle and opening and a tilt switch with safety shutdown feature provided on said main body so that said fan can deliver air flow in an upward and slanted direction relative to said main body without affecting said tilt switch said fan body further having a front grill and a rear casing into which said fan blade assembly, said fan motor and said heating apparatus are housed, said spindle being provided in an upper location and a lower location diametrically opposed on said fan body, the upper spindle portion being hollow to receive the wiring from the fan body to feed through and connect to the control switch in the main body; and said main body being in two symmetrical left and right housing portions, so that the spindle openings from the left housing and the right housing used to secure the spindle of the fan body, can be assembled and disassembled with ease.

2. The cooler-heater fan of claim 1 wherein the lower spindle portion on the fan body includes a hoop, which is a circular strip of resilient metal, the inside diameter of said hoop being smaller than the diameter of the lower spindle, so that the two are tightly gripped together for simultaneous rotation, the front end of the hoop being provided with two legs which protrude outwardly and a block is provided located within said main body, so that when the fan body and the main body are assembled the clamping of the hoop onto the lower spindle allows the fan body to be secured in place, thereby allowing manual adjustment of the direction of said fan body.

3. The cooler-heater fan of claim 1 wherein the angle formed by said fan body and said main body enables the air flow from the front grill to be directed upwardly at an angle of 0 to 45 degrees.

* * * * *